US006276946B1

(12) United States Patent
Stephan

(10) Patent No.: US 6,276,946 B1
(45) Date of Patent: Aug. 21, 2001

(54) PLUG-IN CONNECTION FOR ELECTRIC MOTORS

(75) Inventor: Waldemar Stephan, Dortmund (DE)

(73) Assignee: Wilo GmbH, Dortmund (DE)

( * ) Notice: Subject to any disclaimer, the term of this patent is extended or adjusted under 35 U.S.C. 154(b) by 0 days.

(21) Appl. No.: 09/427,409

(22) Filed: Oct. 25, 1999

(30) Foreign Application Priority Data

Oct. 26, 1998 (DE) ..... 198 49 267

(51) Int. Cl.[7] ..... H01R 12/00
(52) U.S. Cl. ..... 439/83; 439/78; 439/876
(58) Field of Search ..... 439/83, 78–79, 439/81, 874, 875, 876, 884

(56) References Cited

U.S. PATENT DOCUMENTS 4,808,113 * 2/1989 Kanesige et al. ..... 439/67
5,632,629 5/1997 Legrady .

FOREIGN PATENT DOCUMENTS 20 35 326 7/1971 (DE) .
44 22 787 1/1995 (DE) .
196 08 032 9/1997 (DE) .
196 30 424 1/1998 (DE) .
196 30 424A 1/1998 (DE) .

* cited by examiner

*Primary Examiner*—Paula Bradley
*Assistant Examiner*—Truc Nguyen
(74) *Attorney, Agent, or Firm*—Herbert Dubno

(57) ABSTRACT

An electric plug-in connection between a printed circuit board and a stator winding of an electric motor having a socket wired to the winding, the plug-in connection having a single elongated metal strip having one end engaged in the socket and an opposite end formed with first and second spaced-apart contact portions each making a solder connection with the printed circuit board, and a bent portion of the strip forming a flexible connection between the second contact portion and the one end.

12 Claims, 4 Drawing Sheets

PLUG-IN CONNECTION FOR ELECTRIC MOTORS

FIELD OF THE INVENTION

My present invention relates to an electric plug-in connection between at least one winding of the stator of an electric motor and the electronic circuitry provided on a circuit board of the electric motor. More particularly, the invention relates to a plug connection in which a connection can be made between the printed circuit board and a stator winding utilizing a conductor which is soldered to the printed circuit board and engaged in a socket wired to the electric motor stator.

BACKGROUND OF THE INVENTION

Printed circuit boards with plug-in connectors are, of course, known for a variety of applications. In a typical connector of that type, the plug-in member can be soldered to the printed circuit board and can project therefrom to engage in a socket.

In the case of electric motors wherein the socket may be electrically connected to at least one stator winding, the socket makes electrical contact with the plug-in member which communicates the electrical contact to the solder junctions with the printed circuit board. The socket can form a clamping contact, i.e. a contact which clampingly engages opposite sides of an end of the sheet metal strip forming the plug-in contact. It is important in earlier systems of this type that the sheet metal strip be substantially perpendicular to the surface of the printed circuit board and that it be sufficiently stiff so that, on positioning the printed circuit board in the motor housing, the blade formed by the end of the strip opposite that at which solder joints are formed on the printed circuit, is automatically inserted in the socket or clamping contact with sufficient force to spread the latter and enable a good electric connection to be made.

Because of vibrations inherent in the operation of such motors, the solder junction between the metal strip and the printed circuit board can be subjected to significant mechanical load and can break down, especially with aging of the solder junction and/or as a consequence of the application of elevated temperatures to such junctions. In these cases, the solder joints can be damaged or completely broken. The interruption of electrical connections between the stator winding and the electronic circuitry can result in failure of the electric motor and that, of course, can cause other damage elsewhere in a manufacturing plant or wherever the motor is provided. The maintenance of a reliable electrical connection, in spite of such vibrations, is ensured in the system of DE-OS 196 30 424 in which a higher-current contact plug is connected via an additional flexible conductor, especially via a cable, to a solder junction on the printed circuit board. A drawback of this system is that two separate conductors must be used and must be connected together at the plug-in portion of the contact, thereby raising the number of components required and, more significantly, involving higher mounting costs and requiring increasing amounts of time for creation of the assembly.

OBJECTS OF THE INVENTION

It is, therefore, the principal object of the present invention to provide a relatively simple and easily produced plug-in connection of the aforementioned general type, with sufficient strength and stiffness to be easily mounted or formed, which will remain reliable over extended periods of time and which is relatively insensitive to external mechanical effects.

Another object of this invention is to provide a plug-in connection which can be assembled rapidly and inexpensively and which is free from drawbacks of earlier systems.

SUMMARY OF THE INVENTION

These objects and others which will become apparent hereinafter are attained, in accordance with the invention in an electric plug-in connection between at least one winding of the stator of an electric motor and a printed circuit board which carries the control electronic circuits for the electric motor and which is soldered to a first electrical solder contact and which has in the mounted state an end plugged in to a socket connected with the winding. The plug can be formed with a flexible connection with a second electrical solder contact to the printed circuit board.

The two solder contacts and the plug can be formed on a single sheet metal strip and the flexible connection can be formed by a bent region of the sheet metal strip. It is important for the purposes of the present invention that the two solder contact portions and the plug be formed from a single sheet metal strip and that the flexible connection be formed by a bent region of this sheet metal strip.

The electrical plug-in connection of the invention has a relatively simple construction whereby an additional flexible electrical connection is integrated into the plug member. Only a single component need be fabricated and mounted thereby reducing the mounting costs and fabricating costs and the time required for operation. In a relatively simple manner, a one-piece plug connection which is especially easily handled and which has the required strength and structural stability can be fabricated unitarily with the flexible connection which practically makes the plug-in connector immune to external mechanical influences, like, for example, vibration of the electric motor. Should there be a failure of the first solder junction, the second electrical connection between the plug strip and the printed circuit board remains intact and reliable.

It has been found to be especially advantageous to provide the sheet metal strip so that its lower end is slit to form strip segments on either side of the slit. This has been found to provide an especially simple and inexpensive way of providing a plurality of solder junctions. An especially simple and inexpensive formation of the contact member from a single sheet metal blank by a single stamping and bending operation is thus possible.

In further embodiments of the invention, the sheet metal strips can have two or more slits at their lower ends, subdividing these lower ends into three or more partial strips or segments, each of which has a formation at its extremity which can form a solder junction with the printed circuit board and lies opposite the end of the strip which plugs into the socket. The individual segments can each be relatively rigid or can be provided with a flexible or bent region and at least one of these segments can be formed with the flexible bent region while at least one other segment is relatively rigid. It has been found to be advantageous to provide two flexible segments straddling an intermediate rigid segment.

In still another embodiment of the invention, the first solder contact is provided intermediate the length of the sheet metal strip between the second solder contact and the portion of that strip which is plugged into the socket. Here the sheet metal strip is not slit to form strip segments but rather is a single continuous strip. With the embodiments of the invention the flexible region, e.g. between the first and second contact of the single strip or along any of the strip segments can be a zig-zag bend or a bend which is of wave shape, preferably a sinusoidal shape or a meander.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
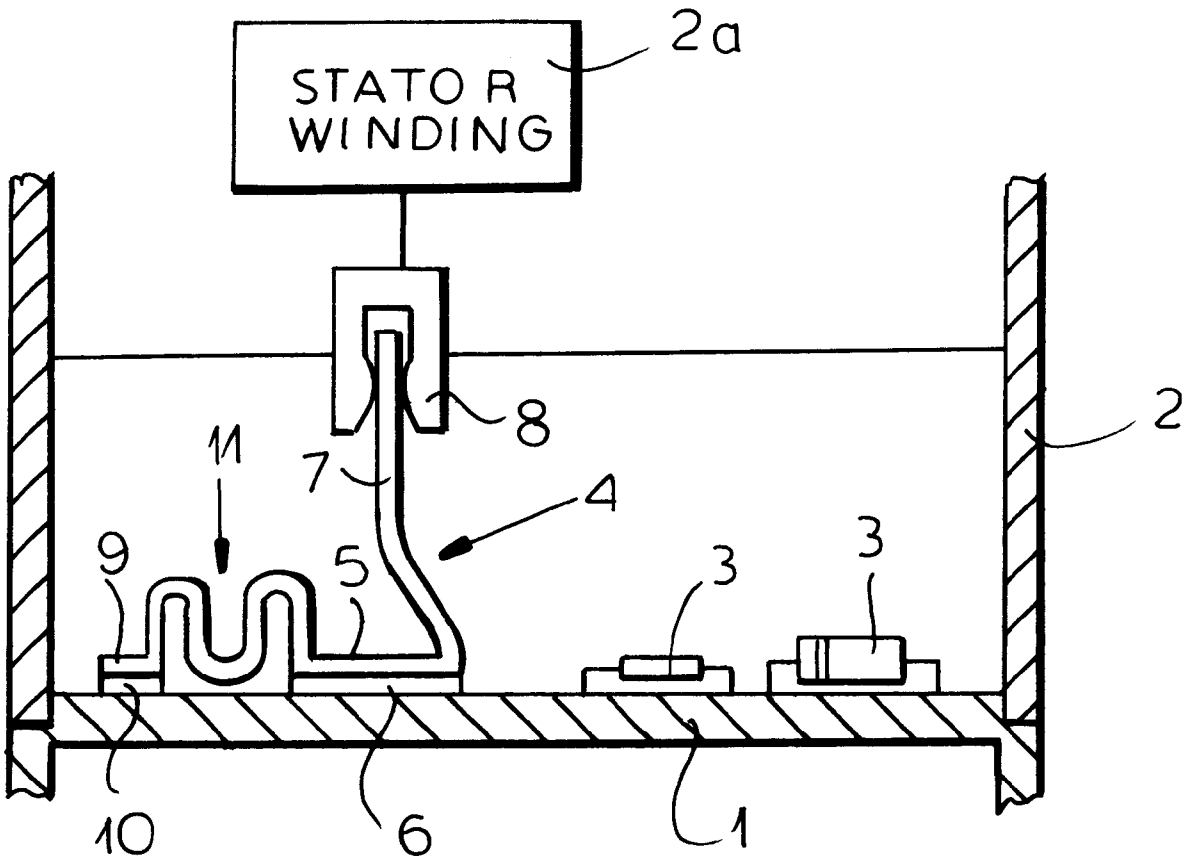
FIG. 1 is a diagrammatic section of a motor housing provided with a contact assembly or plug-in connection in accordance with one embodiment of the invention.

In FIG. 1 I have shown a printed circuit board 1 which can be a board of insulating material such as a composition board, a ceramic substrate or an IMS substrate with a conductor pattern printed thereon and which is fitted into the housing 2 of an electric motor having a stator winding represented highly diagrammatically at 2*a*. The motor has not been shown in greater detail since any particular rotor, stator and casing or housing configuration can be used.

The printed circuit board 1 has also not been shown in detail, except to indicate that it has individual electrical or electronic components 3 which form the electronic circuitry for controlling the motor. Such circuitry can include converter circuitry, speed-control circuitry or circuitry for cutting off the motor in the case of a thermal overload, an excess current draw or overloading of the motor.

Figure 4B:
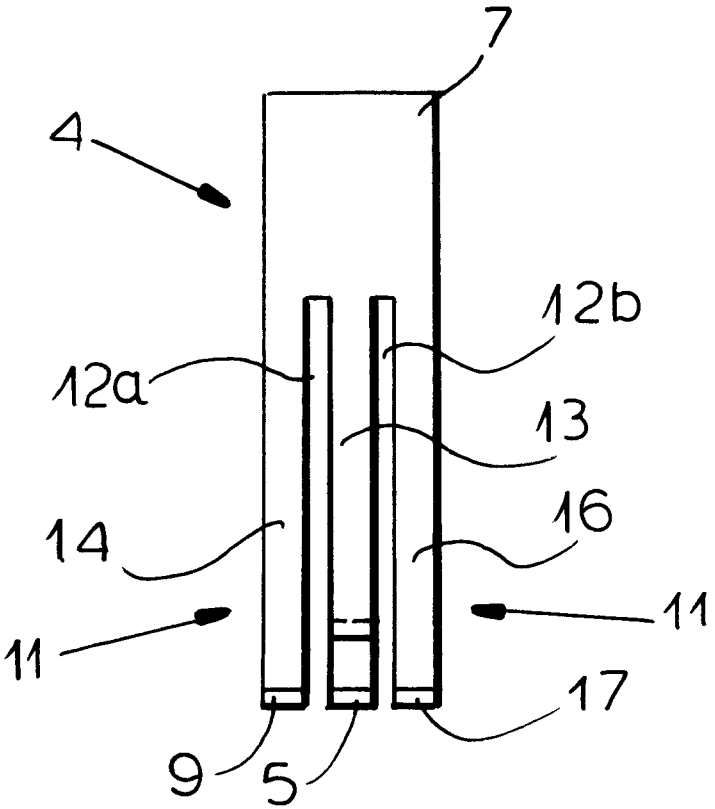
FIG. 4*b* is a front view of this embodiment of the strip connector.
Figure 4A:
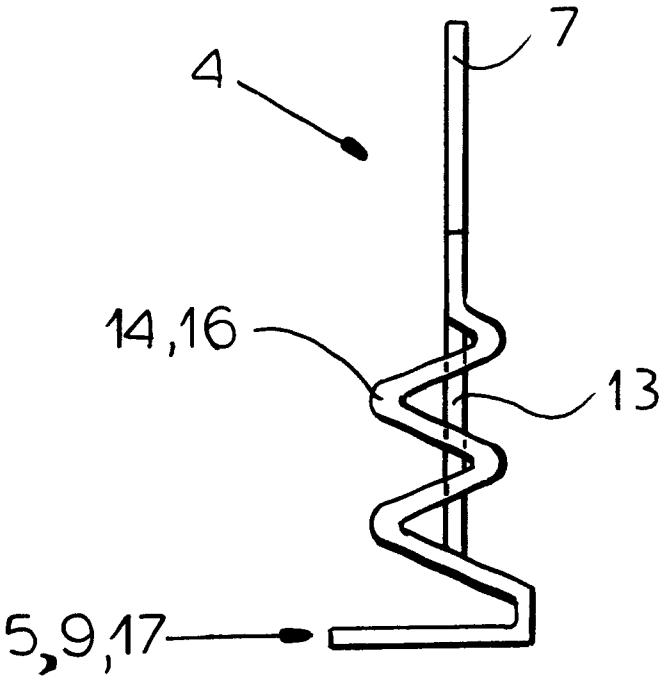
FIG. 4*a* is a side elevational view of a strip connector in accordance with still another embodiment.

The contact of the stator winding 2*a* is a socket 8 of any conventional design, preferably a clamping socket in which the plug portion of a connector strip is engaged between two resiliently spring-loaded contacts biased to one another and engaging opposite broad faces of the strip. The strip itself has been represented at 4 in FIG. 1 and has been shown schematically. It can have the configurations of any of the strips of FIGS. 2*a*, 2*b*; 3*a*, 3*b*, 3*c*; FIGS. 4*a*, 4*b*.

Figure 2B:
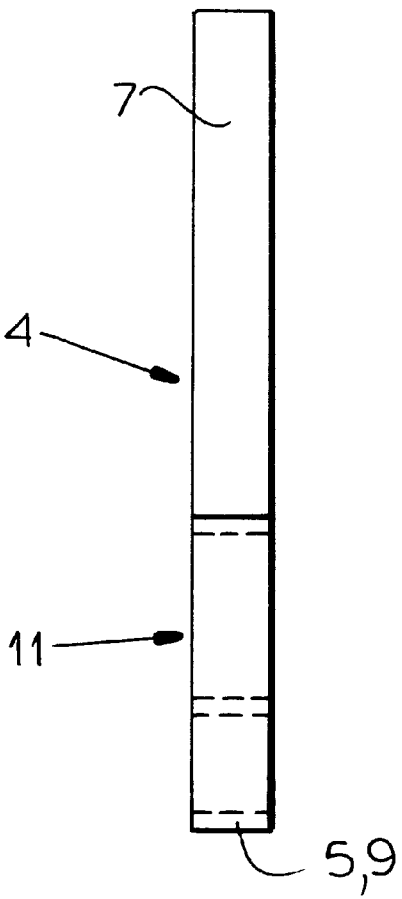
FIG. 2*b* is a front view of that strip.
Figure 2A:
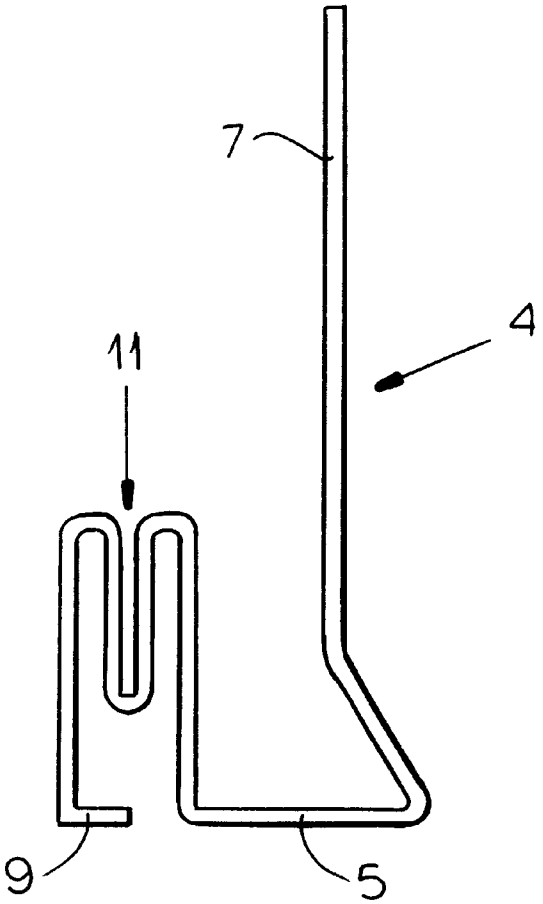
FIG. 2*a* is a side elevational view of another embodiment of the connection strip of the invention for use in the manner described in connection with FIG. 1.

In the embodiment shown in FIG. 1, corresponding in principle also to that of FIGS. 2*a* and 2*b*, the strip 4 is a bent sheet metal strip of a conductive material, e.g. copper or of a stiffer metal such as steel provided with conductivity permitting coating, e.g. of copper.

The strip 4 has a first contact portion or foot 5 connected by a solder junction 6 with the component 3 of the printed circuit board 1. From this contact portion 5, a long shank 7 forms at this free end a plug portion engaged in the socket 8. The shank 7 extends substantially perpendicular to the printed circuit board 1. Of course, a number of such strips can be provided between the printed circuit board and the respective winding of the motor, each of which can have a respective socket 8, or a single socket 8 can be wired to a number of windings.

A second contact region 9, also forms a foot which forms a solder junction 10 with the printed circuit board 1 and is electrically connected to the components 3 thereby. Between the contact portions 5 and 9 the strip 4 is flexible, i.e. provided with a bent portion 11 which, in the embodiment shown, has a wave configuration with a plurality of bends, e.g. two crests and a trough between the crests.

When the solder junction 6 of the first contact portion 5 is destroyed as a result of vibration or the like in the operation of the electric motor, the electric connection between the winding and the electronic circuitry of the printed circuit board is maintained via the second contact region 9 and the flexible portion 11 of the strip. The flexible portion effectively insulates the second solder junction from such vibration.

From FIGS. 2*a* and 2*b* it will be apparent that the strip 4 can be a single relatively narrow sheet metal strip formed unitarily with the contact regions 5 and 9 at respective feet and a multiple bend 11 between them.

Figure 3C:
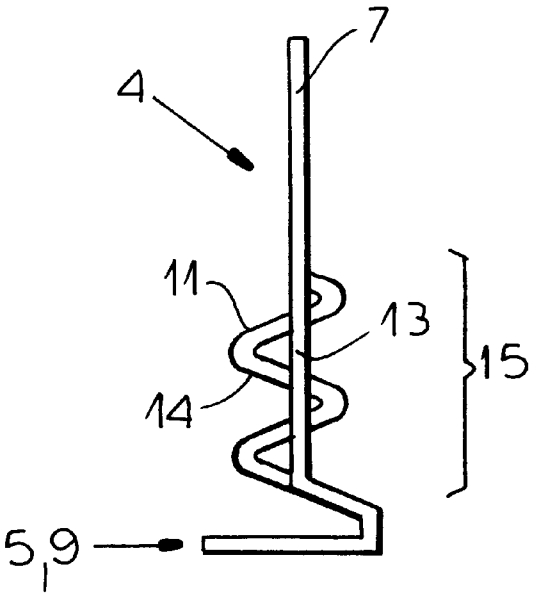
FIG. 3*c* is a side elevational view of the same strip connector from the opposite side.
Figure 3B:
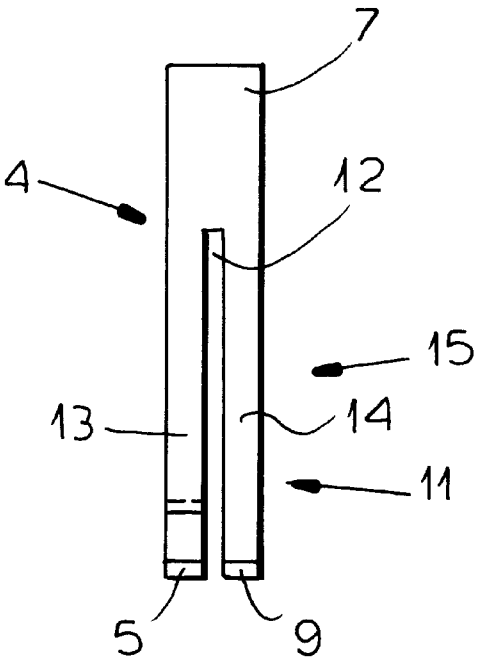
FIG. 3*b* is a front view thereof.
Figure 3A:
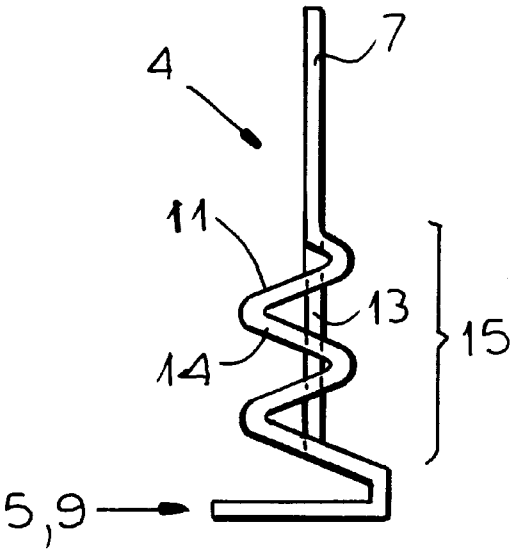
FIG. 3*a* is a side elevational view from one side of another strip connector.

FIGS. 3*a*–3*c* show an especially advantageous embodiment of the strip which can be relatively wide and which can be formed at its lower portion with a slit 12 subdividing the lower portion of the strip into two relatively narrow strip segments 13 and 14. A shorter segment 13 has at its free end the first contact region 5 forming the first solder connection 6 to the printed circuit board while the longer segment 14 is formed with a contact portion 9 at its free end for the second solder junction 10. The second segment 14 has a zig-zag configuration between its contact portion and the shank 7 to form the flexible region 11.

While the length of the segment 14 is greater than that of the segment 13, the zig-zag bend brings the contact portions 5 and 9 into the same plane so that these portions can be identically bent to lie perpendicular to the shank 7, parallel to the printed circuit board 1 and can contact respective conductive portions of the printed circuit board for the formation of the solder junctions thereto. As a consequence, the flexible connection 11 in the second segment 14 makes the contact via the contact portion 9 insensitive to vibration which may rupture the solder connection with the contact portion 5.

In FIGS. 4*a* and 4*b*, an embodiment similar to that previously described provided but with two slits 12*a* and 12*b* subdividing the strip into three segments 13, 14 and 16. A shorter segment 13 has a contact portion 5 at its free end to form the first solder junction 6 while the two longer segments 14 and 16 are flexible and are each provided with the zig-zag bent portions 11 together with contact portions 9 and 17 for further solder connections to the printed circuit board. This connector 4 can thus be soldered at three locations to the printed circuit board.

I claim:

1. An electric plug-in connection between a printed circuit board and a stator winding of an electric motor having a socket wired to said winding, said plug-in connection comprising a single elongated metal strip having one end engaged in said socket and an opposite end formed with first and second spaced-apart contact portions, and respective solder bodies spaced apart from each other each making a solder connection from the other contact portion with said printed circuit board, and a bent portion of said strip forming a flexible connection between said second contact portion and said one end.

2. The electric plug-in connection defined in claim 1 wherein said opposite end is slit to define strip segments separated by a slit, each of said strip segments having at an end thereof opposite said one end of said strip a respective one of said contact portions.

3. The electric plug-in connection defined in claim 2 wherein said opposite end of said strip has at least two slits defining at least three of said strip segments each formed with a respective one of said contact portions.

4. The electric plug-in connection defined in claim 3 wherein said bent portion is formed in at least one of said strip segments.

5. The electric plug-in connection defined in claim 4 wherein a respective said bent portion is formed in each of two of said strip segments.

6. The electric plug-in connection defined in claim 2 wherein said bent portion is formed in at least one of said strip segments.

7. The electric plug-in connection defined in claim 6 wherein said bent portion is formed in only one of said strip segments.

8. The electric plug-in connection defined in claim 6 wherein said bent portion is of zig-zag configuration.

9. The electric plug-in connection defined in claim 1 wherein said first contact portion is formed along said strip substantially midway between said second contact portion and said one end of said strip and said bent portion is located between said first and second contact portions.

10. The electric plug-in connection defined in claim 9 wherein said bent portion is of a wave configuration.

11. The electric plug-in connection defined in claim 1 wherein said bent portion is of wave configuration.

12. The electric plug-in connection defined in claim 1 wherein said bent portion is of zig-zag configuration.

* * * * *